US009725237B2

(12) United States Patent
Johnson et al.

(10) Patent No.: US 9,725,237 B2
(45) Date of Patent: Aug. 8, 2017

(54) INFLATABLE HATCH SEALING DEVICE

(71) Applicant: OPW-Engineered Systems, Inc., Lebanon, OH (US)

(72) Inventors: Don Johnson, Mason, OH (US); Jeff Cousineau, Dayton, OH (US); Ted Shreve, Westfield, NY (US); Mike Crum, Centerville, OH (US)

(73) Assignee: OPW-Engineered Systems, Inc., Lebanon, OH (US)

( * ) Notice: Subject to any disclaimer, the term of this patent is extended or adjusted under 35 U.S.C. 154(b) by 263 days.

(21) Appl. No.: 14/081,518

(22) Filed: Nov. 15, 2013

(65) Prior Publication Data

US 2015/0136778 A1 May 21, 2015

(51) Int. Cl.
*B65D 90/10* (2006.01)
*B65D 90/34* (2006.01)

(52) U.S. Cl.
CPC ..... *B65D 90/10* (2013.01); *B65D 90/34* (2013.01); *B65D 2590/046* (2013.01)

(58) Field of Classification Search
CPC B65D 90/10; B65D 2590/046; B67C 3/2614; B08B 15/00; B08B 15/002; B23D 47/025
USPC ..... 141/287, 285, 383, 290, 312, 392, 1; 137/615; 285/181
See application file for complete search history.

(56) References Cited

U.S. PATENT DOCUMENTS 539,568 A * 5/1895 Bride ..... F16L 55/134 137/240
672,475 A * 4/1901 Cavallaro ..... 166/67
1,683,336 A * 9/1928 Cummings ..... F16J 15/46 138/93
2,763,419 A * 9/1956 Brown ..... B67D 7/54 141/290
2,817,374 A * 12/1957 Brown ..... B65D 90/10 141/342
2,832,378 A * 4/1958 Beacon ..... 141/287
3,103,958 A * 9/1963 Rath ..... 141/96
3,285,308 A * 11/1966 Stambaugh ..... B65D 90/10 220/232
3,606,070 A * 9/1971 Shepherd ..... B65D 90/10 220/210
3,733,764 A * 5/1973 Hege ..... A01F 25/16 220/262
3,786,955 A * 1/1974 Mowatt-Larssen .... B65D 90/10 105/377.07
3,850,210 A * 11/1974 Buxton ..... 141/312
3,863,688 A * 2/1975 Millar ..... B67D 7/54 141/346
3,870,085 A * 3/1975 Schneider ..... E03F 7/02 138/93
4,073,521 A * 2/1978 Mena ..... B63B 19/24 292/1
4,469,152 A * 9/1984 Hardee et al. ..... 141/312
(Continued)

*Primary Examiner* — Allana Lewin Bidder
*Assistant Examiner* — James Hakomaki
(74) *Attorney, Agent, or Firm* — Workman Nydegger

(57) ABSTRACT

Embodiments of the present invention relate to apparatuses, systems, and methods for constructing, installing, and using an inflatable hatch sealing device in environmentally sealing a manhole. In particular, the inflatable hatch sealing device has a sealing assembly with a directed inflatable air bladder, and the sealing assembly is rotatable relative to a contact disc.

20 Claims, 4 Drawing Sheets

(56) References Cited

U.S. PATENT DOCUMENTS

| | | | | | |
|---|---|---|---|---|---|
| 4,518,015 | A * | 5/1985 | Fischer | F16L 55/134 | 138/93 |
| 4,694,594 | A * | 9/1987 | Thorud | E01H 5/098 | 37/233 |
| 5,058,612 | A * | 10/1991 | Winsted | B08B 9/0936 | 134/167 R |
| 5,184,654 | A | 2/1993 | Benzing | | |
| 5,333,653 | A | 8/1994 | Rzesutock et al. | | |
| 5,792,991 | A * | 8/1998 | Nolf | H02G 15/013 | 174/138 G |
| 7,938,631 | B2 * | 5/2011 | Lisi et al. | 417/360 | |
| 8,554,894 | B2 * | 10/2013 | Andrews et al. | 709/223 | |
| 2007/0193649 | A1 * | 8/2007 | Podd | B65D 88/548 | 141/67 |

* cited by examiner

INFLATABLE HATCH SEALING DEVICE

BACKGROUND OF THE INVENTION

1. The Field of the Invention

Implementations of the present invention relate, generally, to the field of reducing environmental pollution during transport or storage of liquids. More particularly, implementations of the present invention are adapted for use in openings for the filling of large transportation and storage tanks, known as manholes.

2. The Relevant Technology

The present invention relates to the liquid storage and transportation industry. In particular, implementations of the present invention relate to the sealing of manholes used as access points to large storage and transportation tanks. These tanks are commonly used in the containment of liquids such as gasoline, diesel fuel, heating oil, and other fuels; acids; alkalis; and other liquid chemical products. Many of these liquids are volatile compounds or may otherwise enter the atmosphere. Even those that are not particularly volatile may have negative environmental impacts if spilled from their containers.

Environmental pollution concerns from tank filling are similar to pollution concerns from filling an automobile gas tank. On a small scale, the problem can be overcome with a vapor control nozzle, as are commonly used in the automobile fueling industry. However, the challenge is amplified on the scale of a bulk transport tank. A typical tanker trailer can hold up to 11,600 U.S. gallons. Due to the large capacity of the trailers, the filling rates must be large, as well. A common filling method is the discharge of liquids into a large opening in the top of the tank called a manhole. The liquid is delivered to the manhole through a conduit known as a loading boom. Loading booms can deliver liquid at a rate of 50-100 gallons per minute or more. Despite being a seemingly smaller effect than spills, vapors released during the filling process may escape and, in sum, account for a larger release of a compound than from spills of liquid. Therefore, a number of solutions have been proposed aimed at reducing the chance or effect of both sources of pollution from the filling of bulk transport tanks.

For instance, one device consists of a filler tube and vapor recovery vent incorporated into a single, cylindrical body that is lowered into place within a manhole. The filler tube allows for the loading boom to discharge liquid into the tank without constraint, and the vapor recovery vent can be connected to a vapor recovery system. Thereby, the filling station can fill the tank at the conventional rate while capturing the vapors generated during the filling process. The body is lowered into place and fixed there with a lockdown bar across the top of the device. The entire device hangs from the lockdown bar affixed the top of the manhole at contact points. The contact points and the lockdown bars allow the device to be secured to the manhole in only two positions that are offset from one another by 180 degrees.

The device has a flexible tube stretched around the perimeter of the device between an outer wall of the body of the device and the interior wall of the manhole. The flexible tube can be deployed to create an annular seal around the cylindrical body. However, while expanding radially, and eventually against the interior wall of the manhole, the tube also expands longitudinally. Inflation of the seal is, therefore, imprecise. Mere contact between the tube and the wall does not ensure a robust seal, while increased inflation undesirably expands the tube longitudinally, leading to over-inflation and weakening of the tube.

Likewise, the device includes a recessed top area that can lead to a number of problems. The recessed top area can act as a well that can accumulate dirt, gravel, ice, water, snow, or any other airborne debris that occurs at filling stations or during storage of the device. This can make the device less reliable or slower to use, as well as shorten the life of the connections housed in the body.

Thus, there are a number of problems that can be addressed with manhole sealing devices.

BRIEF SUMMARY OF THE INVENTION

Implementations of the present invention relate to the environmental sealing of a hatch, commonly referred to as a manhole, during filling of a bulk liquid storage or transportation tank. In particular, implementations of the present invention provide a manhole sealing device that that will quickly and easily seal manholes of various configurations. Further implementations of the present invention provide devices that include a rotatable attachment to the manhole that also allows for optimal alignment of the conduits through the device.

In one example embodiment of the present invention, a device for environmentally sealing a manhole during the filling of a liquid transport tank includes a contact disc and a sealing assembly that are rotatably connected to one another. The contact disc may be selectively securable to the manhole. The sealing assembly may comprise an inflatable air bladder that is deployable to seal the manhole. The rotatable connection may provide a single axis of rotation of both the sealing assembly and the contact disc.

In another embodiment of the present invention, a device for environmentally sealing a manhole during the filling of a liquid transport tank includes an inflatable air bladder disposed on at least a portion of the outer surface of an annular sidewall. The expansion of the inflatable air bladder may be constrained on three sides by the annular sidewall, a first retention member, and a second retention member. The first and second retention members may extend substantially perpendicular to the annular sidewall. The constraint of the inflatable air bladder may be configured to direct the expansion of the air bladder laterally away from the annular sidewall and toward an inner wall of the manhole.

In another embodiment of the present invention, a device for environmentally sealing a manhole during the filling of a liquid transport tank includes a sealing assembly and a contact ring rotatably connected to one another. The sealing assembly may comprise an inflatable air bladder disposed on at least a portion of the outer surface of an annular sidewall. The inflation of the inflatable air bladder may be constrained longitudinally by first and second retention members. The retention members may extend substantially perpendicularly to the annular sidewall and direct the expansion of the inflatable air bladder toward the wall of the manhole. Further, there may be a surface extending over one end of the annulus defined by the annular sidewall. The surface may limit the accumulation of foreign debris within the annulus during storage or operation of the device.

These and other objects and features of the present invention will become more fully apparent from the following description and appended claims, or may be learned by the practice of the invention as set forth hereinafter. The features and advantages of the invention may be realized and obtained by means of the instruments and combinations particularly pointed out in the appended claims.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Implementations of the present invention relate to the environmental sealing of a hatch, commonly referred to as a manhole, during filling of a bulk liquid storage or transportation tank. In particular, implementations of the present invention provide a manhole sealing device that will quickly and easily seal manholes of various configurations. Further implementations of the present invention provide devices that include a rotatable attachment to the manhole that also allows for optimal alignment of conduits through the device.

For example, implementations of the present invention provide a sealing assembly with an efficient sealing mechanism. The sealing assembly includes an inflatable air bladder that is disposed on the outside of an annular sidewall of the assembly. The inflatable air bladder is then disposed within the manhole between an outer wall of the annular sidewall and the inner wall of manhole. To make the seal more robust and more efficient, the assembly then further comprises a pair of retention members at either end of the annular sidewall. The retention members extend substantially perpendicularly from the sidewall and flank the inflatable air bladder when the air bladder is undeployed. As air is introduced to the air bladder, the bladder expands. However, because the air bladder begins in contact with or nearly in contact with the annular sidewall and the two retention members, the air bladder can expand in substantially only one direction. Therefore, nearly any increase in pressure in the air bladder causes the air bladder to expand toward and then press against the inner wall of the manhole, creating a robust seal with little volume of air.

In another implementation of the present invention, a sealing assembly is mounted to the manhole cover with a rotatable contact disc. The contact disc allows for an operator to optimally align the connections in the assembly with the conduits at a filling station. For example, the manhole on a tank may have one or more bolts or other attachment points on the manhole. However, the particular orientation of those attachment points may not line up conveniently with a loading boom used to deliver the liquid to the tank or vapor recovery system used to collect hazardous vapors during filling. Instead of necessitating a repositioning of the tank or the usage of a non-ideal angle for the loading boom, an operator can simply align the sealing assembly with the loading boom by rotating the contact disc and sealing assembly relative to one another until the contact disc is aligned with the attachment points and the sealing assembly is aligned with the loading boom.

Figure 1:
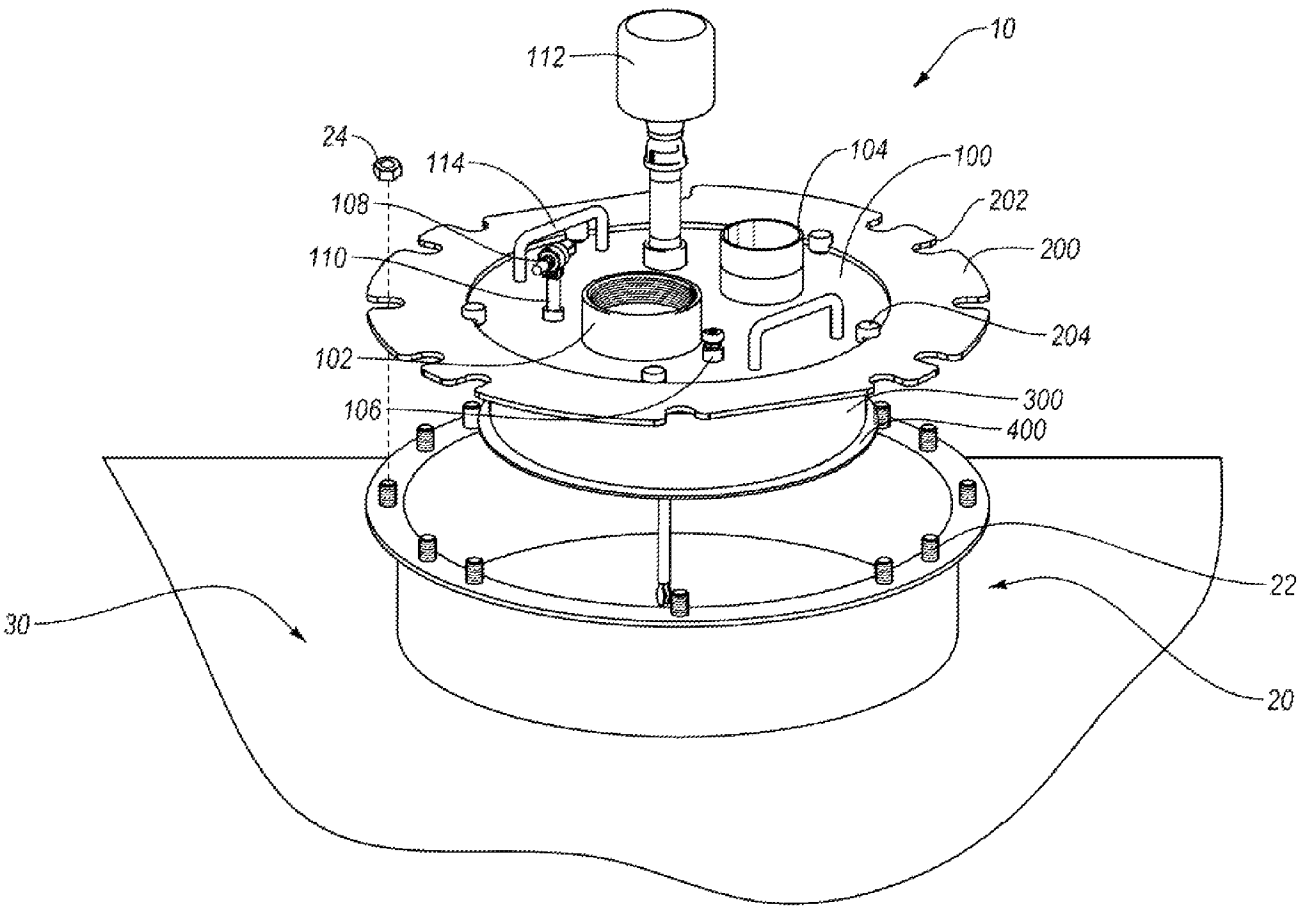
FIG. 1 illustrates a perspective view of an inflatable hatch sealing device according to one implementation of the present invention.

FIG. 1 depicts an inflatable hatch sealing device 10 comprising a surface plate 100, a contact disc 200, an air bladder 300, a retention member 400, and a sidewall 500 (visible in FIG. 3) supporting the air bladder 300. The surface plate 100, air bladder 300, retention member 400, and sidewall 500, collectively, form a sealing assembly.

The surface plate 100 includes a number of connections and valves to allow transmission of a liquid or a gas through the sealing device 10. The surface plate 100 may rest substantially flush with the top of a manhole 20 above a tank 30. The surface plate 100 being flush with the top of the manhole 20 allows the incorporated connections to stand above or at about the same level as the surface of the manhole 20. Standing above or at about the same level as the surface of the manhole 20 may prevent the accumulation of water, dirt, gravel, or other debris in or around the connections or on the sealing device 10. This increases the ease of use of the connections and can speed the filling process. In addition, without the accumulation of water, for example, while raining, the sealing device 10 will not increase in weight. A lighter sealing device 10 eases movement of the device before and after the filling process. Furthermore, with less material accumulating on the surface, there is less risk of contamination to the contents of the tank being filled.

In the illustrated embodiment, the surface plate 100 comprises a fill pipe 102, a vapor recovery pipe 104, a pressure relief valve 106, an air bladder connector 108, an air bladder pipe 110, a level sensor 112, and at least one handle 114. The fill pipe 102 may be threaded, include a twist lock, a clamp, or have other connections to affix a loading boom or other conduit to the fill pipe 102, if desired.

The vapor recovery pipe 104 may be connected to a vapor recovery system (not shown) during filling. A vapor recovery system will trap the vapors released by the liquid during filling of the tank 30 and contain the vapor for other handling. Vapors may be expelled during filling due to increased evaporation from the energy imparted to the liquid during the filling process, as well as due to the increased surface area from the agitation of filling. Furthermore, filling the tank 30 with liquid will displace any vapors produced. To assist the air bladder 300 in sealing the manhole 20, pressure in the tank 30 can be managed by collecting the vapors in a recovery system.

If there is a blockage in the vapor recovery system, however, pressures in the tank 30 may increase to unsafe levels. In such a situation, vapors may escape from the tank 30. Escaping gas under pressure could potentially damage the air bladder 300 or be dangerous to operators. The surface plate 100 may include a pressure relief valve 106 to enable venting of the tank pressure in a controlled manner before the pressure reaches an unsafe level.

Figure 3:
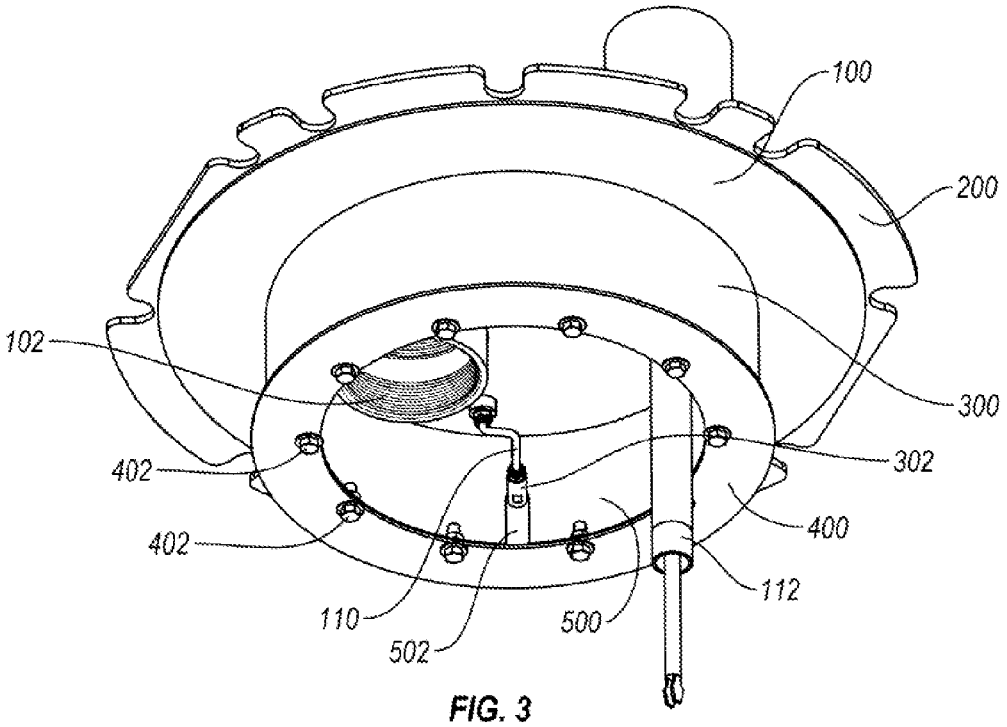
FIG. 3 illustrates a bottom perspective view of the inflatable hatch sealing device of FIG. 1.

The surface plate 100 may include an air bladder connector 108 and an air bladder pipe 110. The air bladder connector 108 may be any appropriate type of connector to enable fluid communication with the air bladder pipe 110. The air bladder pipe 110 extends from the air bladder connector 108 through the surface plate 100. As shown in FIG. 3, the air bladder pipe 110 connects through the sidewall 500 to the air bladder 300. The air bladder 300 can, therefore, be inflated and deflated after the sealing device 10 is lowered into the manhole via the air bladder connector 108 and pipe 110. In addition, the air bladder connection 108 may include a valve for the discharge of air within the air bladder 300 for deflating the air bladder 300.

Further, the surface plate 100 may be configured with a level sensor 112. Level sensors are needed during the filling process because there may not be any ability to directly visually inspect the liquid levels in the tank 30, and the loading boom or other conduit may be capable of very high flow rates. The liquid levels can change quickly and with accompanying rapid pressure changes in the tank 30. As explained in context of the pressure relief valve 106, rapid pressure changes can be dangerous both to the sealing device 10 and personnel. Pressure changes are most rapid as the fill level reaches the top of the tank 30, and the level change can accelerate as the fill level approaches the top of the tank 30 because most transport tanks are horizontal cylindrical containers. There are a number of level sensors available in the industry including a vibrating fork level sensor, such as level sensor 112 illustrated in FIG. 1, SONAR-based sensors, RADAR-based sensors, and other types of sensors known in the art.

The surface plate 100 may include one or more handles 114 to simplify placement and removal of the sealing device 10 from the manhole 20. One or more handles 114 may be affixed to the surface plate 100 to assist movement of the sealing device 10 and to facilitate rotation of the surface plate 100 relative to the contact disc 200 when affixed to a manhole 20. Rotation of the surface plate 100 can allow alignment of the connections in the surface plate 100 with the appropriate conduits, which can ease use of the sealing device 10 at filling stations. In addition or in the alternative, one or more handles 114 may be disposed on the contact disc 200. Locating one or more handles 114 on the contact disc 200 may allow an operator to apply torque to the surface plate 100 more easily and safely.

Still referring to FIG. 1, the contact disc 200 may be an annular disc that comprises openings 202 to mate with bolts on the manhole. The openings 202 may also be holes, recesses, notches, or similar structures. The sealing device 10 is rotatable relative to the manhole 20. The manhole 20, however, may have an array of bolts 22 around the periphery of the opening. The bolts 22 may be a useful fixture point to secure the sealing device 10 to the manhole 20, but the bolts 22 may not be oriented or arranged conveniently for the various conduits an operator may use. The openings 202, as well as the shape of the contact disc 200, generally, may be spaced to facilitate more than one format of manhole.

Figure 2:
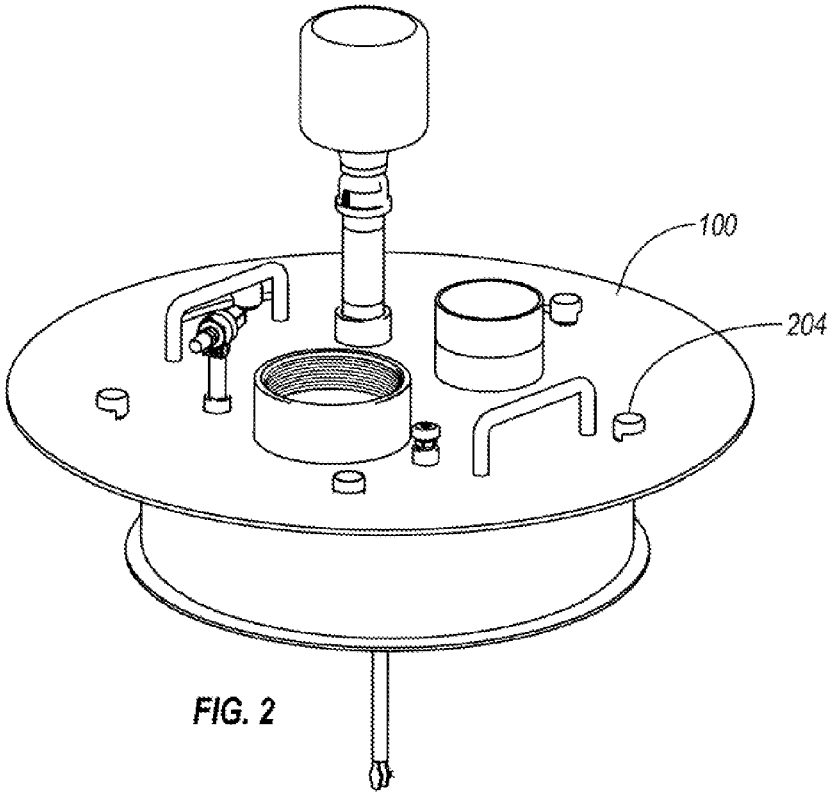
FIG. 2 illustrates a perspective view of the inflatable hatch sealing device of FIG. 1, depicting a rotation mechanism of a contact disc.

In addition, the contact disc 200 and surface plate 100 may have a freely rotatable connection therebetween. As can be seen in FIGS. 1 and 2, the rotatable connection may comprise a plurality of notched posts 204 that may be affixed to the surface plate 100. The notched posts 204 may be affixed to the surface plate 100 and have an upper portion that overhangs the contact disc 200. The overhang may allow sufficient tolerance with a thickness of the contact disc 200 such that the contact disc 200 can rotate relative to the surface plate 100 while remaining attached to the surface plate 100. In the example embodiment illustrated in FIG. 4, the surface plate 100 and the contact disc 200 may be selectively locked together by compression of the surface plate 100 between the manhole 20 and the contact disc 200. The compression force may originate from any compressive connection between the manhole 20 and the contact disc 200. In the illustrated embodiment, the bolts 22 may provide the compression force in conjunction with nuts 24 (such as those visible in FIGS. 4 and 5). In another embodiment, the contact disc 200 may be in contact with the manhole 20 and the surface plate 100 may not be. In such an embodiment, the sealing assembly may still rotate freely after the contact disc 200 is secured to the manhole 20.

Referring now to FIG. 3, in an embodiment, the air bladder 300 may be disposed between the surface plate 100 and the retention member 400. The air bladder 300 may be disposed around the entire periphery of the sidewall 500 and may contact the sidewall 500 when in an undeployed state. The constraint on three sides of the air bladder 300 may direct expansion of the air bladder 300 primarily laterally and substantially prevent expansion or movement of the air bladder 300 longitudinally with respect to the sidewall 500 and manhole 20. The constraint of the air bladder 300 may be performed by the sidewall 500 and at least two retention members. In an embodiment, the air bladder 300 may be constrained by the surface plate 100, retention member 400, and sidewall 500, wherein the surface plate 100 performs the function of a second retention member. In another embodiment, the second retention member and the surface plate may be distinct portions of the device.

The air bladder 300 may be made of an elastic material to allow expansion of the air bladder 300 with increase in internal pressure. The air bladder 300 may have an air stem 302 to allow connection of the air bladder pipe 110 and the air bladder 300. The air stem 302 may pass through a bladder connection port 502 in the sidewall 500. In an embodiment, the bladder connection port 502 is a notch that restrains motion of the air stem with respect to the sidewall 500 in either direction laterally and toward the surface plate 100 longitudinally. A notch configuration also provides the benefit of facilitating replacement of the air bladder 300 if it becomes worn or damaged. The air stem 302 may slide out of the notch when the retention bolts 402 are loosened and the retention member 400 is removed. Alternatively, the bladder connection port 502 may, in addition, restrain motion of the air stem 302 in both directions longitudinally.

Figure 4:
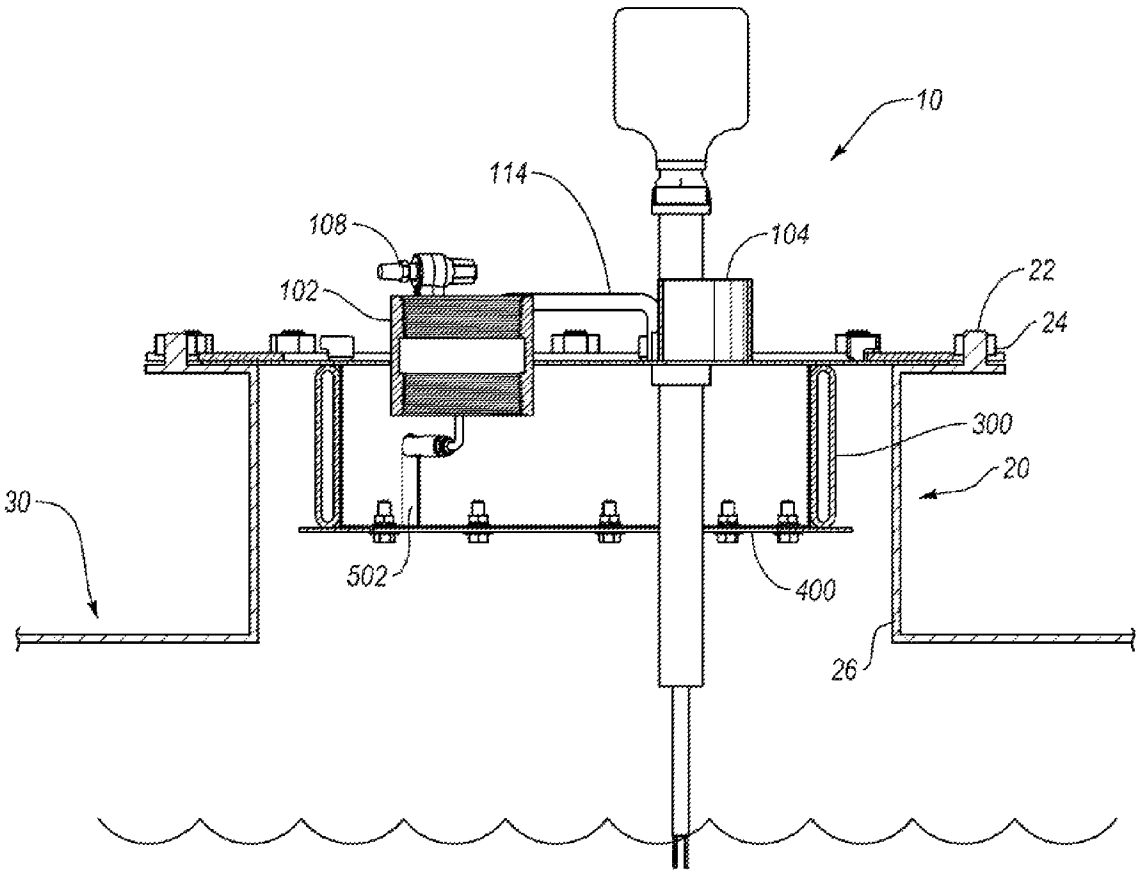
FIG. 4 illustrates a cross-section view of the inflatable hatch sealing device of FIG. 1 with a seal undeployed.

Referring now to FIG. 4, the retention member 400 is connected to the sidewall 500 by the retention bolts 402. The retention member 400 may extend laterally beyond the sidewall 500 and beyond the air bladder 300 when the air bladder 300 is in a undeployed state, as shown in FIG. 4. The retention member 400 has an outer diameter smaller than a diameter of a manhole inner wall 26. In an embodiment, the retention member 400 may have an outer diameter less than 6" smaller than the diameter of the manhole inner wall 26. In another embodiment, the retention member 400 may have an outer diameter of greater than 6" smaller than the diameter of the manhole inner wall 26. In yet another embodiment, the retention member 400 may have an outer diameter of about 3" smaller than the diameter of the manhole inner wall 26. In yet another embodiment, the retention member 400 may have an outer diameter of about 2" smaller than the diameter of the manhole inner wall 26.

The outer diameter of the retention member 400 should allow an operator to place the sealing device 10 into the manhole 20 but also extend beyond the air bladder 300 when the air bladder 300 is in an undeployed state. The ratio of the difference between the outer diameter of the retention member 400 and the outer diameter of the annular sidewall 500 and the difference between the outer diameter of the undeployed air bladder 300 and the outer diameter of the annular sidewall 500 is the "undeployed ratio." In an embodiment, the undeployed ratio is less than about 3:2. In another embodiment, the undeployed ratio is between about 3:2 and about 3:1. In yet another embodiment, the undeployed ratio is greater than about 3:1.

The ratio of the difference between the outer diameter of the retention member 400 and the outer diameter of the annular sidewall 500 and the difference between the outer diameter of the deployed air bladder 300 and the outer diameter of the annular sidewall 500 is the "deployed ratio." In an embodiment, the deployed ratio is less than about 2:3. In another embodiment, the deployed ratio is between about 2:3 and about 1:3. In yet another embodiment, the deployed ratio is greater than about 1:3. The deployed and undeployed ratios may apply as well to the surface plate 100 when the surface plate 100 performs the function of the second retention member, as well.

Figure 5:
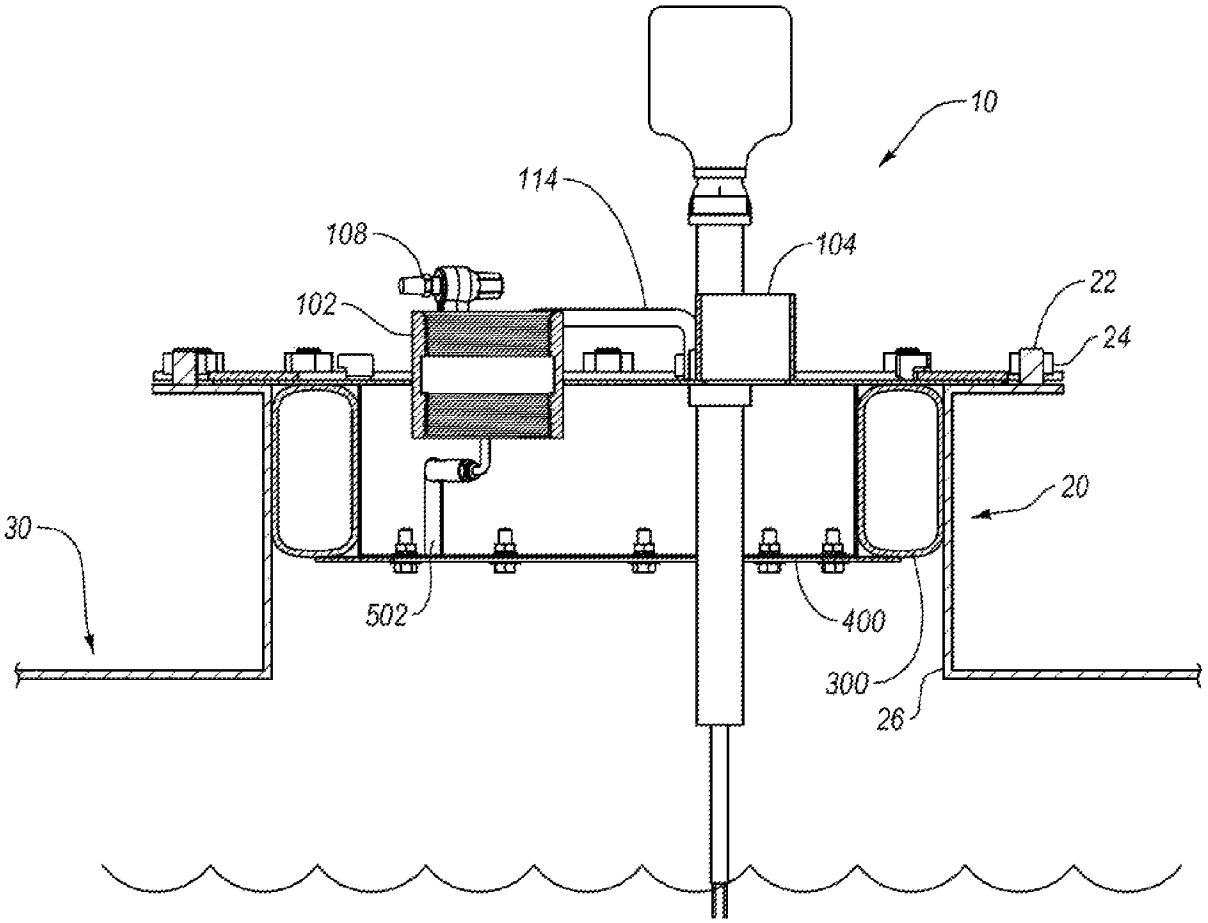
FIG. 5 illustrates a cross-section view of the inflatable hatch sealing device of FIG. 1 with the seal deployed.

As can be seen in FIGS. 4 and 5, the retention member 400 may work in conjunction with the surface plate 100 to direct the expansion of the air bladder 300 laterally with respect to the sidewall 500 and manhole inner wall 26. In bounding the expansion of the air bladder 300 longitudinally, an increase in volume of the air bladder 300 will result in a substantially lateral expansion of the air bladder 300 toward the manhole inner wall 26. Bounding the air bladder 300 longitudinally also causes a greater increase in air bladder diameter for the same amount of increase in volume. Therefore, an operator can provide gas to the air bladder 300 through the air bladder connector 108 and pipe 110, expand the air bladder 300, and attain a satisfactory seal between the air bladder 300 and the manhole inner wall 26 in a shorter period of time versus an unbounded air bladder.

In addition to bounding the expansion of the air bladder 300, the retention member 400 may also serve to protect the air bladder 300 during use, transportation, and storage of the sealing device 10. In the absence of a retention member 400 having a larger diameter than the air bladder 300 in an undeployed state, the air bladder 300 could strike the wall of the manhole 20 during installation and removal of the device, potentially causing damage to the air bladder 300. Furthermore, a device without a retention member having a larger diameter than the air bladder 300 in an undeployed state could be stored on its side when not in use, resting directly upon the air bladder. With the retention member 400 having a larger diameter than the air bladder 300 in an undeployed state, the air bladder 300 is more protected and may perform better and for a longer period of time before needing replacement.

As shown in FIG. 4, an operator may lift an inflatable hatch sealing device 10 by the handles 114 and place the device 10 on top of and covering a manhole 20 leading into a tank 30. The operator can align the notches 202 in the contact disc 200 with one or more manhole bolts 22, and, if necessary, may secure the sealing device 10 with nuts 24. Once the contact disc 200 is placed upon the manhole 20, the contact disc 200 can remain stationary, as the rest of the sealing device 10 is rotated using the handles 114 until the operator has aligned any necessary connections with their respective conduits.

Next, the operator can connect a source of air, such as an air compressor, compressed air tank, or similar, to the air bladder connector 108. Once connected, the source of gas is in fluid communication with the air bladder 300 via the air bladder pipe 110. As seen in FIG. 5, the air bladder 300 may expand laterally when filled with air, extending beyond the outer diameter of the retention member 400 and contacting the inner wall 26 of the manhole 20. With the longitudinal bounding of the air bladder 300 by the surface plate 100 and the retention member 400, the air bladder 300 may be "deployed" and thereby form a sufficient seal with the manhole wall 26 for environmental protection purposes at a low air pressure in the air bladder 300. In an embodiment, the air bladder is deployed at between about 5-10 psi. In another embodiment, the air bladder 300 is deployed at between about 10-13 psi. In yet another embodiment, the air bladder is deployed at between about 13-15 psi.

Once the air bladder 300 is deployed, the operator may connect a loading boom to the fill pipe 102 and a vapor recovery system to the vapor recovery pipe 104. Upon completion of the filling process, the operator can remove the loading boom and vapor recovery systems from the fill pipe 102 and vapor recovery pipe 104, respectively, and then deflate the air bladder 300 via the air bladder connector 108. Once the air bladder 300 is undeployed, any nuts 24 may be removed from the manhole bolts 22 and the inflatable hatch sealing device 10 may be lifted off of the manhole 20 by the handles 114.

The terms "approximately," "about," and "substantially" as used herein represent an amount close to the stated amount that still performs a desired function or achieves a desired result. For example, the terms "approximately," "about," and "substantially" may refer to an amount that is within less than 10% of, within less than 5% of, within less than 1% of, within less than 0.1% of, and within less than 0.01% of a stated amount.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A device for the sealing of a manhole, the device comprising:

a contact disc selectively securable to the manhole; and a sealing assembly comprising an inflatable air bladder, a first retention member, and a second retention member, the contact disc and the sealing assembly being rotatably connected together by a plurality of notched posts that are connected to the second retention member, the sealing assembly being configured to environmentally seal the manhole, the sealing assembly being rotatably connected to the contact disc such that the sealing assembly may be freely rotated relative to the contact disc while the contact disc is secured to the manhole, the first retention member and the second retention member each having an outer diameter that is larger than an outer diameter of the inflatable air bladder when the inflatable air bladder is in an undeployed state.

2. The device of claim 1, wherein the sealing assembly further comprises an annular sidewall.

3. The device of claim 1, wherein the contact disc is an annulus and the sealing assembly is disposed within an outer diameter of the annulus.

4. The device of claim 1, wherein the inflatable air bladder is selectively deployable from the undeployed state to a deployed state, the inflatable air bladder having an outer diameter in the deployed state that is greater than the outer diameter of the first retention member.

5. The device of claim 4, wherein the second retention member has an outer diameter greater than the outer diameter of the inflatable air bladder when the inflatable air bladder is in the deployed state.

6. The device of claim 1, wherein a ratio of a difference between the outer diameter of one of the retention members and an outer diameter of an annular sidewall and a difference between the outer diameter of the inflatable air bladder when the inflatable air bladder is in the undeployed state and the outer diameter of the annular sidewall is less than about 3:2.

7. The device of claim 1, wherein the plurality of notched posts extend from the second retention member in a direction away from the inflatable air bladder.

8. The device of claim 1, wherein each of the plurality of notched posts comprises an upper portion that overhangs the contact disc to secure the contact disc to the second retention member while allowing for rotation of the sealing assembly relative to the contact disc when the contact disc is connected to the manhole.

9. The device of claim 1, wherein the contact disc is selectively securable to the sealing assembly in one or more positions.

10. The device of claim 5, wherein the inflatable air bladder has between about 5-15 psi therein when in the deployed state.

11. The device of claim 2, wherein the annular sidewall defines an annulus, and wherein at least one end of the annulus defined by the annular sidewall is sufficiently closed to limit the accumulation of water, dirt, gravel, or other debris within the annulus.

12. A device for sealing of a manhole, the device comprising:

an annular sidewall;

an inflatable air bladder disposed proximate to at least part of an outer surface of the annular sidewall, the inflatable air bladder being selectively deployable from an undeployed state to a deployed state, the inflatable air bladder having a first outer diameter in the undeployed state and a second outer diameter in the deployed state;

a first retention member extending substantially perpendicular to the outer surface of the annular sidewall, the first retention member being disposed on a first axial side of the inflatable air bladder, the first retention member having an outer diameter that is larger than the first outer diameter of the inflatable air bladder such that the first retention member extends radially beyond the inflatable air bladder when the inflatable air bladder is in the undeployed state; and a second retention member extending substantially perpendicular to the outer surface of the annular sidewall, the second retention member being disposed on a second axial side of the inflatable air bladder, the second retention member having an outer diameter that is larger than the first outer diameter of the inflatable air bladder such that the second retention member extends radially beyond the inflatable air bladder when the inflatable air bladder is in the undeployed state, wherein the first and second retention members are configured to direct the expansion of the inflatable air bladder perpendicular to the outer surface of the annular sidewall;

a contact disc rotatably connected to the second retention member, the contact disc being selectively connectable to the manhole, wherein the second retention member is rotatable relative to the contact disc when the contact disc is connected to the manhole; and a plurality of notched posts connected to the second retention member, each of the notched posts of the plurality of notched posts having an upper portion that overhangs the contact disc to secure the contact disc to the second retention member while allowing for rotation of the second retention member relative to the contact disc when the contact disc is connected to the manhole.

13. The device of claim 12, wherein the outer diameter of the second retention member is greater than the second outer diameter of the inflatable air bladder when the inflatable air bladder is in the deployed state.

14. The device of claim 12, wherein at least one of the first and second retention members is disposed at an end of the annular sidewall.

15. The device of claim 12, wherein a ratio of a difference between an outer diameter of one of the retention members and an outer diameter of the annular sidewall and a difference between the second outer diameter of the inflatable air bladder and the outer diameter of the annular sidewall is less than about 2:3.

16. The device of claim 12, wherein a ratio of a difference between an outer diameter of one of the retention members and an outer diameter of the annular sidewall and a difference between the second outer diameter of the inflatable air bladder and the outer diameter of the annular sidewall is between about 2:3 and about 1:3.

17. The device of claim 12, wherein a ratio of a difference between an outer diameter of one of the retention members and an outer diameter of the annular sidewall and a difference between the second outer diameter of the inflatable air bladder and the outer diameter of the annular sidewall is greater than about 1:3.

18. A device for sealing of a manhole having an inner diameter and outer diameter, the device comprising:

a sealing assembly configured to environmentally seal the manhole, the sealing assembly comprising:

an annular sidewall defining an annulus;

an inflatable air bladder disposed on at least a portion of an outer surface of the annular sidewall, the inflatable air bladder being selectively deployable from an undeployed to state to a deployed state, the inflatable air bladder having a first outer diameter in the undeployed state and a second outer diameter in the deployed state;

a first retention member disposed on a first side of the inflatable bladder, the first retention member having an outer diameter that is larger than the first outer diameter of the inflatable air bladder such that the first retention member extends radially beyond the inflatable air bladder when the inflatable air bladder is in the undeployed state;

a second retention member disposed on a second side of the inflatable bladder, the second retention member having an outer diameter that is larger than the first outer diameter of the inflatable air bladder such that the second retention member extends radially beyond the inflatable air bladder when the inflatable air bladder is in the undeployed state;

a plurality of notched posts connected to the second retention member, the plurality of notched posts extending in a direction away from the inflatable air bladder, each of the notched posts of the plurality of notched posts comprising an overhanging upper portion;

at least one surface disposed at an end of the annular sidewall configured to sufficiently close the annulus to limit accumulation of water, dirt, gravel, or other debris within the annulus; and an air bladder connector, the air bladder connector being in fluid communication with the inflatable air bladder; and a contact disc rotatably connected to the sealing assembly and being selectively securable to the manhole, wherein the overhanging upper portions of the plurality of notched posts overhang the contact disc to secure the contact disc to the second retention member while allowing for rotation of the sealing assembly relative to the contact disc when the contact disc is connected to the manhole.

19. The device of claim 18, wherein the sealing assembly further comprises one or more conduits through the at least one surface.

20. A method for sealing of a manhole, the method comprising:

positioning a sealing device at least partially within a manhole, the sealing device including an inflatable air bladder, a first retention member disposed on a first side of the inflatable air bladder, a second retention member disposed on a first side of the inflatable air bladder, and a contact disc rotatably connected to the second retention member via one or more notched posts that enable the sealing device to rotate relative to the second retention member;

securing the contact disc to the manhole;

rotating the sealing device relative to the contact disc after securing the contact disc to the manhole; and inflating the inflatable air bladder from an undeployed state to a deployed state, wherein inflating the inflatable air bladder comprises increasing an outer diameter of the inflatable air bladder from a first outer diameter to a second outer diameter, the first outer diameter of the inflatable air bladder being less than an outer diameter of each of the first retention member and the second retention member, and the second outer diameter of the inflatable air bladder being greater than the outer diameter of at least one of the first retention member and the second retention member.

* * * * *